166-66 SR
7/6/76 XR 3,967,678

United States Patent [19]

Blackwell

[11] 3,967,678

[45] July 6, 1976

[54] STUFFING BOX CONTROL SYSTEM

[75] Inventor: Henry Wayne Blackwell, Venus, TX

[73] Assignee: Dresser Industries, Inc., Dallas, Tex.

[22] Filed: June 2, 1975

[21] Appl. No.: 583,146

[52] U.S. Cl. ..... 166/53; 166/66; 166/84; 277/28

[51] Int. Cl.[2] ..... E21B 43/00

[58] Field of Search ..... 166/53, 66, 84; 277/28, 277/103

[56] References Cited

UNITED STATES PATENTS

| | | | |
|---|---|---|---|
| 1,754,946 | 4/1930 | Haskell | 166/53 |
| 3,145,995 | 8/1964 | Adamson et al. | 166/53 |
| 3,207,221 | 9/1965 | Cochran et al. | 277/28 |
| 3,276,246 | 10/1966 | Truman et al. | 277/28 |
| 3,532,163 | 10/1970 | Ecuer | 166/53 |
| 3,731,742 | 5/1973 | Sizer et al. | 166/53 |
| 3,863,714 | 2/1975 | Watson, Jr. | 166/53 |

*Primary Examiner*—James A. Leppink
*Attorney, Agent, or Firm*—Michael J. Caddell

[57] ABSTRACT

A stuffing box and associated control system having the facilities for sensing a leak past the polished rod seals and for correcting the leak by adjustment of the seals, utilizes a pressurized piston system for tightening the seals around the polished rod and also features means for signalling the well operator about the leak, for shutting down the pumping apparatus, and for achieving a final pack-off of the wellhead.

15 Claims, 3 Drawing Figures

STUFFING BOX CONTROL SYSTEM

BACKGROUND OF THE INVENTION

The present invention is directed generally to a rod pump stuffing box and more specifically discloses a stuffing box and its associated control system, with means for increasing the pack-off pressure in the stuffing box upon the leakage of well fluids reaching a predetermined level.

Most conventional polished rod sealing devices are the type whereby the means for maintaining the packing seals in sealing engagement with the polished rod consists solely of manual adjusting devices. These stuffing boxes must be closely monitored by the well operator to prevent a loss of well fluids and contamination of the surrounding environment.

This invention solves the problems of the prior devices by providing an automatic system for detecting leaking stuffing box seals and for adjusting the packing in response to a predetermined amount of leakage. Further leakage after the packing adjustment has been accomplished will shut the pump down, and continued leakage after pump shutdown activates a total pack-off of the stuffing box on the polished rod.

DESCRIPTION OF THE PREFERRED EMBODIMENTS

Figure 1:
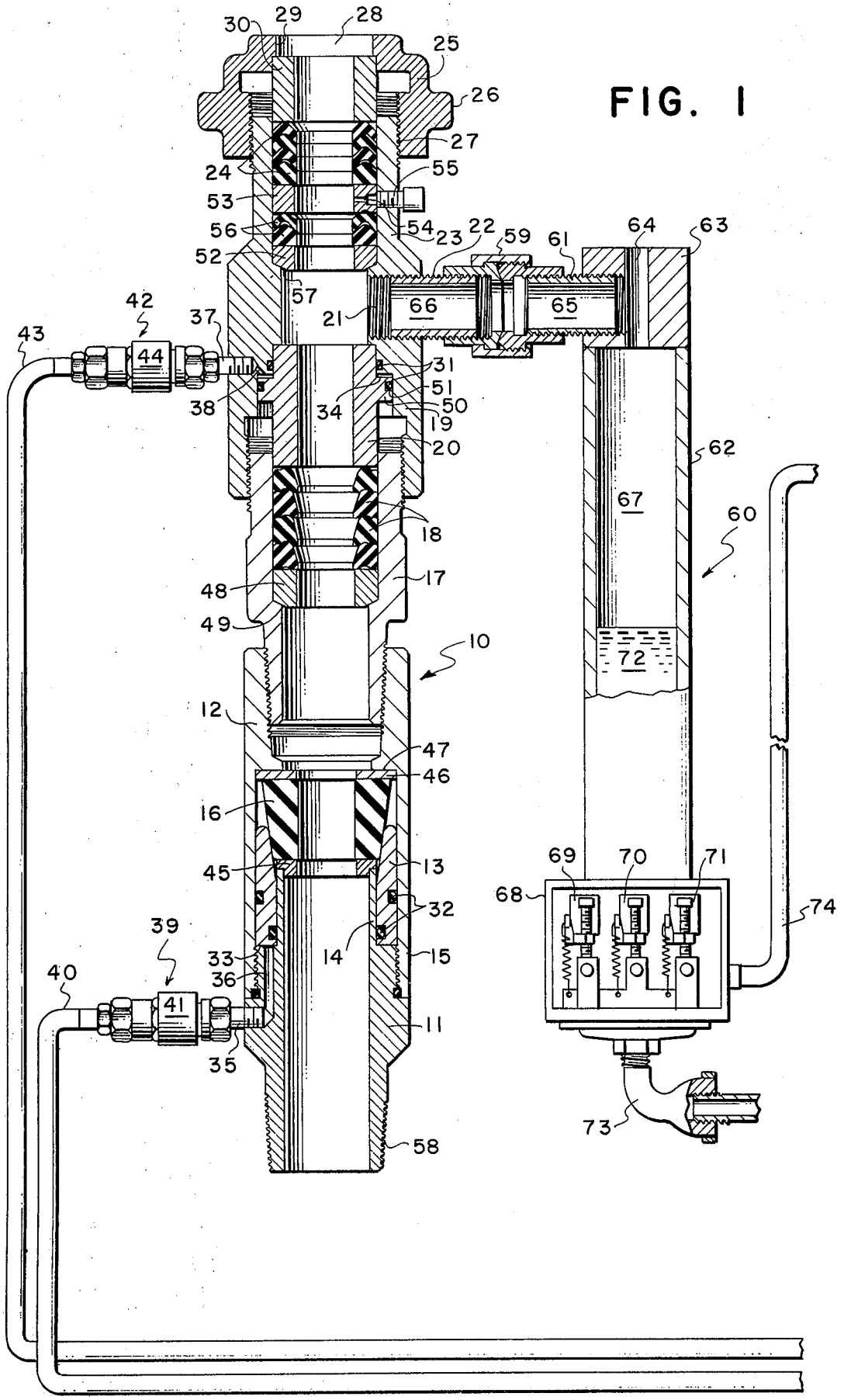
FIG. 1 is a cross-sectional side elevation view of the stuffing box of the invention.

Referring to FIG. 1, a stuffing box assembly 10 is disclosed generally comprising a lower cylindrical wellhead adapter 11 upon which is threadedly attached a piston cylinder 12 containing a sleeve-type piston 13 which is located in slidable and sealing engagement between an upper skirt 14 of wellhead adapter 11 and a lower skirt 15 of cylinder 12. Piston sleeve 13 is arranged in slidable wedging abutment with a circular elastomeric pack-off sleeve 16. Threadedly engaged in the upper portion of cylinder 12 is an upper seal retainer housing 17 containing one or more circular elastomeric seal rings 18.

An upper piston housing 19 is threadedly engaged on seal housing 17 and contains therein a cylindrical piston sleeve 20 in slidable sealing engagement in housing 19 and in abutment with seal rings 18. A fluid outlet 21 is formed in the wall of housing 19 and a fluid conduit 22 is threadedly engaged in outlet 21. Piston housing 19 has an upper chamber section 23 adapted to receive a plurality of seal rings 24 therein. A threaded cap 25 having external tightening lugs 26 is threadedly engaged at threads 27 at the upper end of housing 19. Cap 25 has a top opening 28 therein and an inwardly projecting annular flange shoulder 29 surrounding opening 28. Flange shoulder 29 abuts a sleeve 30 pushing it downward against seal rings 24. Tightening of cap 25 onto housing 19 serves to move sleeve 30 against flexible seals 24 thereby flexing them radially inward against a polished rod passing therethrough.

It should be noted that all of the components of assembly 10 are adapted to receive a polished rod or polished liner passing through bore passages located substantially along the central longitudinal axes of each of the components. Piston sleeves 20 and 13 each utilize seal means such as O-rings at 31 and 32 respectively for sealing engagement within assembly 10. Each piston sleeve 13 and 20 further has pressure response surfaces thereon which response surfaces are numbered 33 and 34 respectively.

A pressure conduit system 35 threadedly engaged in the wall of wellhead adapter 11 and in fluidic communication with channel 36 provides fluid access to pressure response surface 33 on piston 13. Similarly, the fluid conduit system 37 threadedly engaged in the wall of housing 19 and communicating with fluid passage 38 provides fluid access to pressure surface 34 on piston 20.

Fluid conduit system 35 has a fitting assembly 39 to which is connected supply conduit 40. Preferably, assembly 39 utilizes a back flow checkvalve 41 therein. Similarly, conduit system 37 has a fitting assembly 42 attached to a supply conduit 43 and utilizes a back flow checkvalve 44.

A tee-shaped foundation ring 45 located within assembly 10 is adapted for relatively snug fitting relationship upon and within the upper end of skirt 14. Seal sleeve 16 rests upon ring 45 and a back-up washer 46 is provided at the opposite end of seal sleeve 16 which washer 46 abuts an inner annular shoulder 47 formed within piston cylinder 12. Likewise, seal rings 18 are in abutment with an upper seal retainer ring 48 which is in abutment with a lower shoulder 49 formed within seal housing 17.

Piston sleeve 20 comprises a generally cylindrical sleeve body having an outwardly projecting annular shoulder 50 formed thereon with pressure surface 34 being located along the top side of shoulder 50 and one O-ring 31 being located within an O-ring channel 51 in the outer perimeter of shoulder 50. Seal rings 24 located within upper section 23 of housing 19 ride on top of a lubrication sleeve 53 which is slidably located within chamber 23 and which contains a lubrication passage 54 communicating with a lubrication fitting 55 threadedly engaged in the upper chamber section 23.

Lower seals 56 are in abutment with the underside of ring 53 and rest upon a retainer ring 52 in abutment with an inwardly formed annular shoulder 57 in housing 19. The stuffing box assembly 10 is adapted by means of a lower threaded end 58 for threaded engagement in a standard wellhead assembly containing a polished rod extending upward therethrough. Attached to fluid outlet conduit 22 by means of a threaded union 59 is a fluid level sensing and signalling system 60 connected to union 59 by means of a nipple 61. The fluid level sensing system 60 contains a generally tubular receptacle 62 suspended from a manifold head 63 having longitudinal passage 64 formed therethrough, which passage 64 communicates via bore 65 and 66 of nipple 61 and conduit 22 to fluid outlet 21. Passage 64 also provides venting to the atmosphere to allow escape of gas pressure. Fluid bypassing sleeves 16 and leaking by packing 18 flows outward through port 21 and into receptacle 62.

Located at the bottom of receptacle 62 and in communication with the chamber area 67 therein is a pressure switching box 68 having a set of three pressure sensitive switches 69, 70, and 71 operatively connected therein. Each of these pressure switches is actuated by the hydrostatic head of well fluid 72 collected within chamber 67. Each switch is further adapted to be actuated at a different hydrostatic head than the other two switches. Thus, the switches are arranged for sequential operation as fluid within chamber 67 rises to a higher level.

Alternative leak detection means might include float switches in column 62, photoelectric cells dispersed along the vertical height of column 62, magnetic proximity switches along the vertical column wall with a magnetic float in the column responsive to the fluid level, and micro-switches mechanically activated by a float member in the column. Likewise, instead of using three pressure sensitive switches of varying sensitivity at the bottom of the column, three pressure sensitive switches with substantially equal sensitivity could be placed at different vertical locations in the column, with the spacing between them determining the difference in required amounts of leaked fluid to activate them.

A fluid drain valve 73 is provided at the bottom of the level sensing system 60 so that, once the system has been actuated and reset, fluid collected within chamber 67 may be drained off to a proper receptacle so that the fluid may be removed from the well site without contamination of the surrounding environment. Electric signal leads from switches 69 through 71 pass out of box 68 through conduit 74 and into the control panel 80 as illustrated in FIG. 2.

Figure 2:
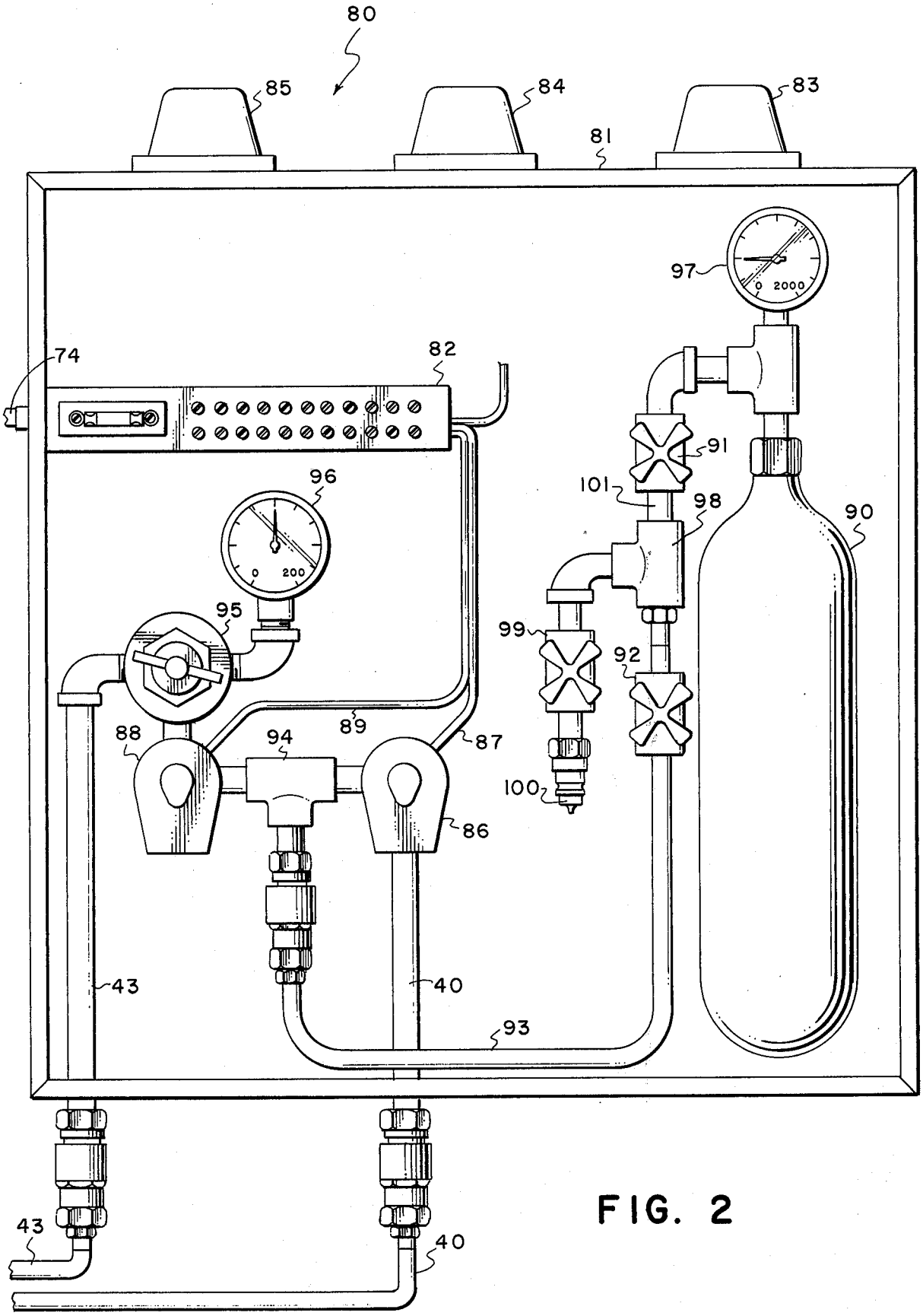
FIG. 2 is a schematic illustration of the control system associated with the stuffing box; and, FIG. 3 is a schematic wiring diagram illustrating one possible embodiment of the electrical system of the invention.

Referring now to FIG. 2, the control panel assembly 80 has a control panel box 81 containing an electric terminal bar 82 to which are connected signal lamps 83, 84, and 85. Also connected to the terminal bar 82 is a secondary solenoid 86 connected by conduit 87 and a primary solenoid 88 connected by conduit 89 to the terminal bar 82. Secondary solenoid 86 is connected to pressure conduit 40 communicating with the lower piston sleeve pressure surface 33. Primary solenoid 88 communicates by means of pressure conduit 43 with the upper piston sleeve pressure surface area 34.

A pressurized gas source 90 located within control box 81 communicates through valves 91 and 92, conduit 93, and tee 94 to the primary and secondary solenoids. A pressure regulator 95 and pressure gauges 96 and 97 may be located in the pressure system to allow monitoring and control of the actuating air pressure supplied to the piston sleeves 20 and 13.

Pressure regulator 95 is provided in the pressure supply line 43 to the primary seal rings 18 so that the amount of compression of seal rings 18 by piston 20 may be controlled closely. This prevents the seal rings from being compressed too tightly, introducing high friction between the rings and polished rod, and tearing up the seal rings. The desired amount of compression of the primary packing is obtained by adjusting the pressure regulator 95 to obtain the desired pressure level on piston sleeve 20.

Alternatively, the area of pressure response surface 34 can be altered during the designing of the system to limit the amount of compression of the primary packing 18. A second alternative would be to limit the amount of movement of piston sleeve 20 in housing 19 by forming a travel stop shoulder in seal housing 17 directly below piston 20.

A flow tee 98 is provided in line 93 from pressure source 90 so that the gas pressure may be recharged therein. This may be accomplished by closing valve 92 and opening valves 91 and valve 99 in recharge line 101. A gas recharge source is connected to recharge nozzle 100 and pressurized gas is injected therein until satisfactory filling of bottle 90 has been accomplished. Valve 99 may then be closed and valve 92 reopened and the system is recharged and ready for operation.

In typical operation, the stuffing box assembly 10 is placed over the polished rod and threaded into the wellhead. The cap 30 may be tightened to provide a pack-off against the polished rod above the normal sealing rings 18 and sealing sleeve 16. Likewise, threading of housing 19 downward on housing 17 provides a longitudinal compression of seal rings 18 by sleeve 20 thereby expanding them radially inward into contact with the polished rod.

After the various threaded adjustments have been made and the seal rings are properly seated against the polished rod to provide sealing engagement therewith without unduly restricting movement of the polished rod therethrough by friction between the seals and the polished rod, the pumping operation may be started. After the rod pump operates over an extended period of time, seal rings 18 will begin to wear.

It should be noted at this point that during installation of the stuffing box assembly 10, it is usually preferable to obtain most of the sealing against the polished rod through use of seal rings 18 maintaining seal sleeve 16 as back-up sealing capacity and packings 24 used primarily for lubrication dispensal. As seal rings 18 begin to wear appreciably, fluid leakage will occur thereby which leakage will flow upward through piston sleeve 20 until it passes out through outlet port 21. Fluid leakage through port 21 moves along bore 66 and 65 through passage 64 whereupon it flows downward into chamber area 67 and is collected at 72.

As the fluid level 72 begins to rise in cylinder 62, the first of the pressure actuated switches 69 through 71, which first switch is naturally the most pressure sensitive, will be activated generating a signal through conduit 74. This signal energizes a certain section of terminal bar 82 which section has output leads to lamp 83 and to the primary solenoid 88. Upon activation of this section of the switching assembly, lamp 83 will be lit and solenoid 88 will be actuated, thereby releasing pressurized gas from source 90 through conduit 43 to pressure face 34 on piston sleeve 20. This influx of pressurized gas against piston sleeve 20 moves the piston downward, abutting seal rings 18 and compressing them longitudinally while expanding them radially inward against the polished rod.

This should be sufficient to stop any fluid leakage thereby and allow an extended period of continuing production of pumped fluid from the well. The continued operational period will extend past any normal time required for the well operator to check his well. Upon checking the well, the operator will be alerted by the lighted signal lamp 83 that leakage had begun to occur from the stuffing box and a first remedial sequential step has been taken by the automatic system to prevent such leakage.

At this time, the well operator may wish to deactivate the signal by draining the collected fluid 72 through drain valve 73 until the first pressure switch 69 is deactivated. At this time solenoid 88 is switched off and the pressure supply is no longer communicated to piston sleeve 20. The pressure in the line 43 may be bled off and the well operator may then wish to mechanically tighten seal rings 18 by advancing piston housing 19 downward on the threaded section of seal housing 17, which threaded advancement moves piston 20 downward into longitudinal compression against seal sleeves 18. Should the well operator not notice the adjusted condition of seal rings 18 caused by the pressurizing against piston 20, then these rings will continue to hold sealing engagement for an extended period of time. But after such period of time, wear within sealing rings will again cause leakage to occur thereby, which leakage will continue to raise the level of fluid 72.

A second pressure sensitive switch 70 is activated by the increased hydrostatic pressure due to the higher fluid level 72 in chamber 16. Activation of the second pressure switch works through conduit 74 to energize a second section of terminal bar 82 which energization serves to light lamp 84 and switch off power to the rod pump prime mover. After the pump has been shut down, the well will usually cease to flow due to the low pressure of fluids in the well which low pressure is usually not sufficient to drive the fluid up through the stuffing box and out past the seals.

In some circumstances however, some wells will continue to leak fluid through the stuffing box even after the rod pump has ceased pumping operations. Under these circumstances, fluid 72 in receptacle 62 will continue to rise as it leaks past seals 18 until it reaches a level sufficient to establish enough hydrostatic head to activate the least sensitive pressure switch 71. Activation of switch 71 generates a signal through conduit tube 74 to terminal bar 82, which signal activates a section of the terminal bar thereby lighting lamp 84 and actuating secondary solenoid 86. Actuation of solenoid 86 opens conduit 40 to pressure from source 90 through tee 94. The pressurized gas flows through conduit 40 and passage 36 to pressure surface 33 on piston sleeve 13. This pressure force drives sleeve 13 upward into wedging engagement around pack-off sleeve 16 which serves to contract sleeve 16 into tight sealing engagement about the polished rod.

It should be noted that the sensitivity of switches 70 and 71 should have a sufficiently different range in order to allow time for the pumping unit to shut down completely and cease all motion of the polished rod. This is to prevent destruction of the pack-off sleeve 16 when it is clamped tightly about the polished rod. A tee ring 45 and washer 46 provide end supports for sleeve 16 to prevent extrusion thereof. This third and final sequential operation is a permanent, very tight pack-off in the stuffing box against the polished rod therein, which pack-off is so tight as to prevent absolutely any further leakage of fluid through the stuffing box and may actually be tight enough to prevent sliding movement of the polished rod through the pack-off sleeve. This final sequential operation thereby prevents any leaked fluid to escape the stuffing box assembly and contaminate the environment around the well site. Upon arriving at the well site, the well operator easily determines from the number of lamps which may be lighted atop the control box exactly what condition the stuffing box sealing system is in at the present time. Should all three lights be lighted, the operator knows that a substantial overhaul of the sealing system will be required before placing the well back on production.

As an alternative to the positive lighting indicator lamp system as described above, it may be desirable to utilize a negative lighting system whereby as the various pressure sensitive switches are activated, they turn off the continuously lighted lamps sequentially. Thus, as the operator checks a well and sees one or more lamps not lighted, he knows that something on the well needs to be checked. The advantage of this system over the above-described positive lighting system is clear when you consider what the effect of a burned-out or a shorted-out lamp may be with the two systems. One or more burned-out bulbs on the positive system might disguise the fact that one or more sequential steps had already been carried out by the stuffing box system and the well operator would not know that the system was in operation and further mechanical tightening of the seals should now be attempted. A burned-out bulb on the negative system indicates that some action is needed by the well operator and he, as a matter of course, shouldd check the lamp bulbs first for such a cause.

Figure 3:
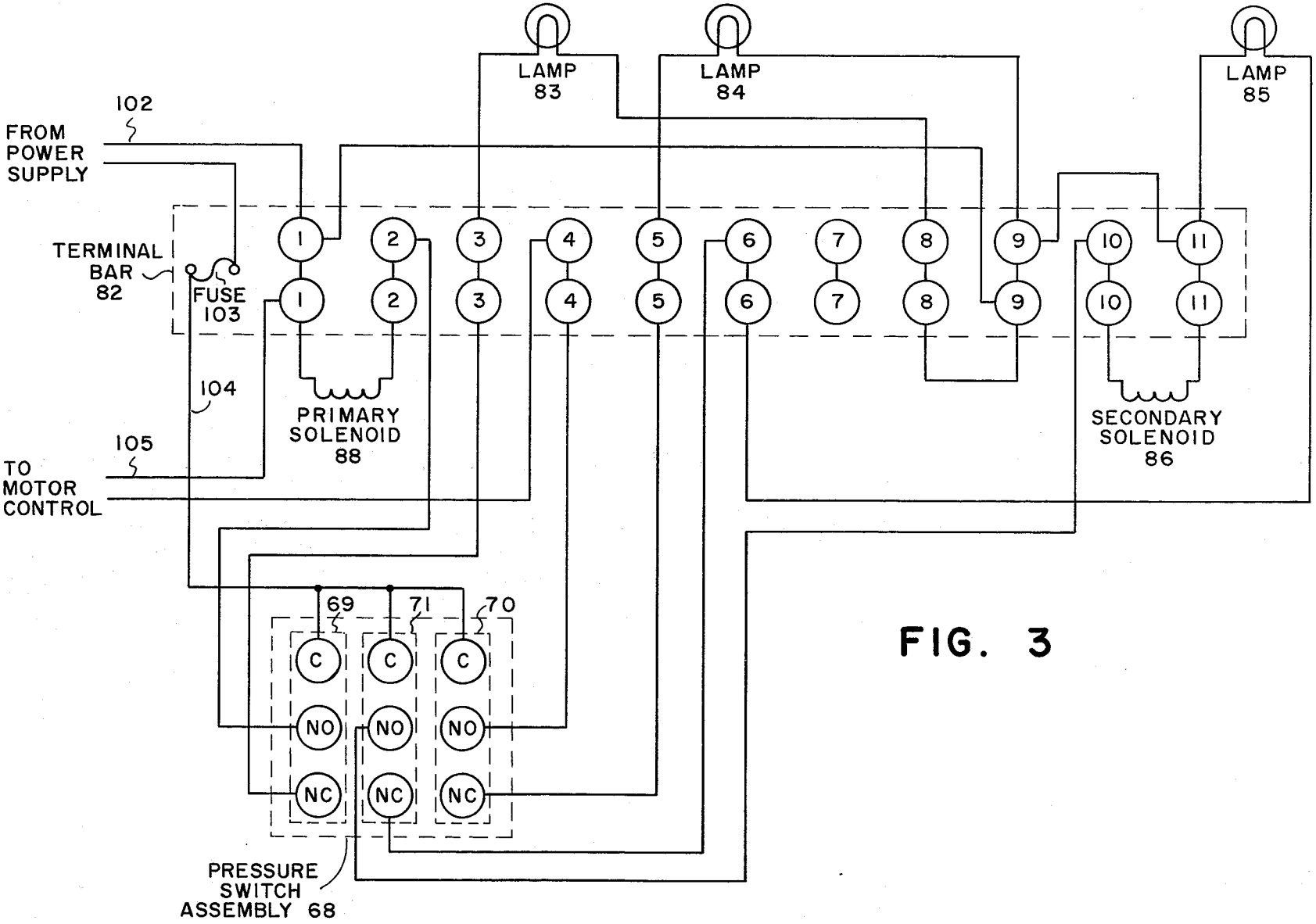

FIG. 3 illustrates in partial schematic a wiring diagram for the electrical system of the stuffing box control.

In the figure, the terminal bar 82 receives electrical power through leads 102 from an available power source, with a fuse 103 in the circuit. Power flows through lead 104 to the common terminals C of switches 69–71. Power also flows to the normally closed contacts NC of the switches to which are connected the signal lamps 83–85. This wiring diagram embodies the continually lighted warning system which is described above and is referred to as the negative lighting indicator system. Wiring for the positive lighting system would involve moving the lamp connections from the NC terminals to the normally open (NO) terminals.

The normally open contacts NO of the pressure switches 69–71 are connected by conductor leads to their various operative components such as the primary and secondary solenoids and to one of the power supply leads 105 to the motor control. The actuation of the pressure sensitive switches opens the NC contact and closes the NO contact thereby turning off a signal lamp and simultaneously actuating either a solenoid or the motor control.

The motor control could be of any type, either electrical, mechanical, or pneumatic, designed to either cut off power or to disengage the motor from the rod pump unit. Closing of the NO contact of switch 70 serves to apply electric power to the motor controller which power activates the controller and shuts down the pump motor. For instance, if the pump unit utilizes a gas or liquid-fuel powered internal combustion engine, the motor controller could be an electrically powered cut off valve in the fuel supply line. The controller for an electric powered pumping unit could be a solenoid or circuit breaker in the electric power line to the pump motor.

Thus, it can be seen that the present invention provides a three step sequential operation designed to increase the sealing ability of the stuffing box assembly against the polished rod and, when the sealing ability seems to have worn substantially to shut down the pumping unit, to provide a very tight pack-off against the polished rod to prevent any contamination of the environment.

Although certain preferred embodiments of the invention have been herein described in order to provide an understanding of the general principles of the invention, it will be appreciated that various changes and innovations can be affected in the described stuffing box and control system without departing from these principles. For example, it is obvious that one could add any number of sealing assemblies to the stuffing box merely by adding additional pressure switches to the fluid receptacle assembly 60 by adding additional solenoids to the control box with gas pressure conduits passing from the solenoids to the additional seal assemblies. It is also clear that the stuffing box control system could be modified by removal of either one or both of the pressure pistons 13 and 20 and replacing these pistons and their associated elastomeric seal means with seal means having pressure expansion grooves around their outer periphery. Thus, operation of such modified apparatus would involve communicating pressurized gas to the outer peripheral channel of said modified seal means which pressurized gas forces these seals into a radially inward contraction into tighter sealing engagement with the polish rod. The use of said pressure responsive seals would eliminate the need for sliding pressure pistons abutting on the elastomeric seal rings.

Such modifications would only require slight modification of the stuffing box housing to eliminate the piston chamber area and establish a seal chamber area having relatively snug longitudinal fit with a pressure access opening around the outer perimeter of the seal member communicating from the pressure groove in the seal member through bypass means in the housing wall to the conduits 40 and 43 connected to the pressure source. The invention, therefore, is declared to cover all changes and modifications of the specific example of the invention herein disclosed for purposes of illustration, which do not constitute departures from the spirit and scope of the invention.

The embodiments of the invention in which an exclusive property or privilege is claimed are defined as follows:

1. A rod-pump stuffing box system for attachment to a wellhead having a rod pumping unit; said system comprising:

housing means adapted to encircle a rod-pump polished rod and attached to a wellhead;

seal means in said housing means adapted to be urged into sealing engagement with said housing means and a polished rod passing therethrough;

piston means mounted slidably in said housing means, having a pressure response surface thereon, and arranged to abut said seal means;

pressure source means adapted for communicating pressurized fluid to said pressure response surface;

leak detection means communicating with said housing means and arranged for detecting well fluid leakage past said seal means; and, actuator means operably connected to said detection means and said pressure source means and arranged to actuate said pressure source means upon detecting a predetermined amount of well fluid leakage.

2. The stuffing box system of claim 1 further comprising power cutoff means operably connected to said leak detection means and the power source for the well rod pump, said cutoff means adapted to cutoff activating power to the well rod pump upon detection by said leak detection means of leaked well fluid of a second predetermined amount exceeding said first predetermined amount.

3. The stuffing box system of claim 2 further comprising pack-off means in said housing means adapted to be urged into tight sealing engagement against said housing means and a polished rod passing therethrough; and second actuator means operably connected to said leak detection means and said pack-off means and arranged to actuate said pack-off means in response to a third amount of detected leaked well fluid, said third amount exceeding said second amount.

4. The stuffing box system of claim 3 wherein said pack-off means comprises flexible seal ring means and piston sleeve means, said piston sleeve means being in abutment with said seal ring means and having a pressure response surface thereon arranged for communication with said pressure source means through said second actuator means.

5. The stuffing box system of claim 4 wherein said leak detection means comprises a leak collection column having pressure sensitive switch means therein arranged to be actuated by pressure of leaked fluid collected in said column.

6. The stuffing box system of claim 5 wherein said switch means comprises three pressure-actuated electro-mechanical switches each adapted to generate an electrical signal in response to actuation by pressure thereon; said switches arranged for sequential operation by varying amounts of fluid in said column.

7. The stuffing box system of claim 3 wherein said first and second signal actuator means each comprise solenoid valves adapted to be opened by electric actuation.

8. The stuffing box system of claim 5 wherein said switch means comprises three pressure-sensitive switches each adapted to close at a different pressure than the others, and said three switches being located at the bottom of said column.

9. The stuffing box system of claim 5 wherein said switch means comprises three pressure-sensitive switch means located at differing vertical locations in said column.

10. The stuffing box system of claim 3 further comprising visual indicator means on said system operably connected to said actuator means and arranged to give visual indication of activation of said actuator means.

11. A stuffing box assembly having automatic leak control system therein, said assembly comprising:

a generally cylindrical stuffing box housing adapted for engagement in a wellhead;

flexible seal means in said housing adapted for sealing engagement with a polished rod passing therethrough;

means for selectively compressing said seal means radially inward against a polished rod; said compression means being actuable by pressurized fluid acting thereon;

pressure supply means arranged for selective fluid communication with said compression means;

leak detection means communicating with said housing and arranged to detect fluid leakage past said seal means; and, actuating means communicating with said detection means and said pressure supply means, and arranged to actuate said compression means upon detecting a predetermined amount of leaked well fluid.

12. The stuffing box assembly of claim 11 further comprising means operably connected to said detection means and adapted to cut-off power to a well pumping unit in response to a second predetermined amount of leaked fluid detected by said detection means.

13. The stuffing box assembly of claim 12 further comprising pack-off means in said housing adapted for fluid tight sealing engagement against a polished rod passing therethrough; pack-off compression means in said assembly arranged to compress said pack-off means into inward radial engagement with a polished rod; and, pack-off actuating means communicating with said detection means and said pressure supply means and arranged to actuate said pack-off compression means upon detecting a third predetermined amount of leaked well fluid.

14. A self adjusting stuffing box system for use on an oil well having a rod-pump installed in a well, a wellhead at the surface, and a power driven pump jack connected to the rod-pump by a sucker rod string and polished rod, said stuffing box system comprising:

a generally cylindrical housing assembly adapted to be connected to a wellhead in encircling engagement about a polished rod;

dynamic seal means in said housing assembly adapted for slidable sealing engagement with a polished rod passing through said housing assembly;

seal compression means in said housing assembly arranged to contract said dynamic seal means radially inward against a polished rod;

pack-off seal means in said housing assembly arranged to be expanded radially inward into fluid-tight static sealing engagement with a polished rod passing therethrough;

pack-off compression means arranged to contract said pack-off seal means radially inward into static engagement with a polished rod;

fluid collection means in fluid communication with said housing assembly and arranged to receive well fluid leaking past said dynamic seal means;

signal means in said fluid collection means arranged to generate a plurality of sequential signals in response to the amount of fluid collected in said collection means;

pressurized fluid supply means having fluid conduits communicating with said housing assembly;

actuator means connected to said signal means and said pressurized fluid supply means and arranged to selectively supply compressed fluid to said housing assembly in response to said sequential signals;

passage means in said housing assembly arranged to communicate said fluid conduits with said seal compression means and said pack-off compression means; and, power cut-off means operably connected to said signal means and responsive to said sequential signals to selectively cut-off motivating power to the pump jack.

15. The stuffing box system of claim 14 further comprising visual indicator means on said system connected to said signal means and responsive to said sequential signals to generate visual signals indicative of the amount of accumulated leakage from said housing assembly.

* * * * *